United States Patent [19]

Sweetland

[11] 4,423,708

[45] Jan. 3, 1984

[54] LIQUID COOLING UNIT FOR AN INTERNAL COMBUSTION ENGINE

[75] Inventor: Roger D. Sweetland, Columbus, Ind.

[73] Assignee: Cummins Engine Company, Inc., Columbus, Ind.

[21] Appl. No.: 336,286

[22] Filed: Dec. 31, 1981

[51] Int. Cl.[3] ..... F02M 1/00

[52] U.S. Cl. ..... 123/196 AB; 123/41.33; 123/196 R; 165/51; 184/6.5; 184/104 B

[58] Field of Search ..... 123/196 AB, 196 R, 41.33; 165/74, 119, 51; 210/184, 186; 184/6.5, 104 B

[56] References Cited

U.S. PATENT DOCUMENTS 2,075,708 3/1937 Evans ..... 165/74
2,212,250 8/1940 Schutt ..... 165/74

FOREIGN PATENT DOCUMENTS 1193310 5/1965 Fed. Rep. of Germany ... 123/41.33

*Primary Examiner*—Charles J. Myhre
*Assistant Examiner*—E. Rollins Cross
*Attorney, Agent, or Firm*—Neuman, Williams, Anderson & Olson

[57] ABSTRACT

A cooling unit is provided for an internal combustion engine wherein the latter is provided with a first interior portion having external inlet and outlet ports through which a first liquid circulates and a second interior portion through which a second liquid circulates. The second interior portion is provided with an access opening. The unit includes a base section which overlies the access opening and is sealingly secured to surface portions circumjacent the access opening. The base section is provided with a first set of ports which register with the inlet and outlet ports of the first interior portion, and a second set of ports. Mounted on one side of the base section is a heat exchange section which projects through the access opening into the second interior portion. The exterior of the heat exchange unit is contacted by the circulating second liquid. The interior of the heat exchange section is provided with a passageway through which the first liquid circulates. Mounted on and in sealing engagement with a second side of the base section is a cover section which is provided with a plurality of passages. One of the passages interconnects one of the first set of ports with one of the second set of ports and a second of the passages interconnects another of the first set of ports with another of the second set of ports.

7 Claims, 4 Drawing Figures

FIG. 1
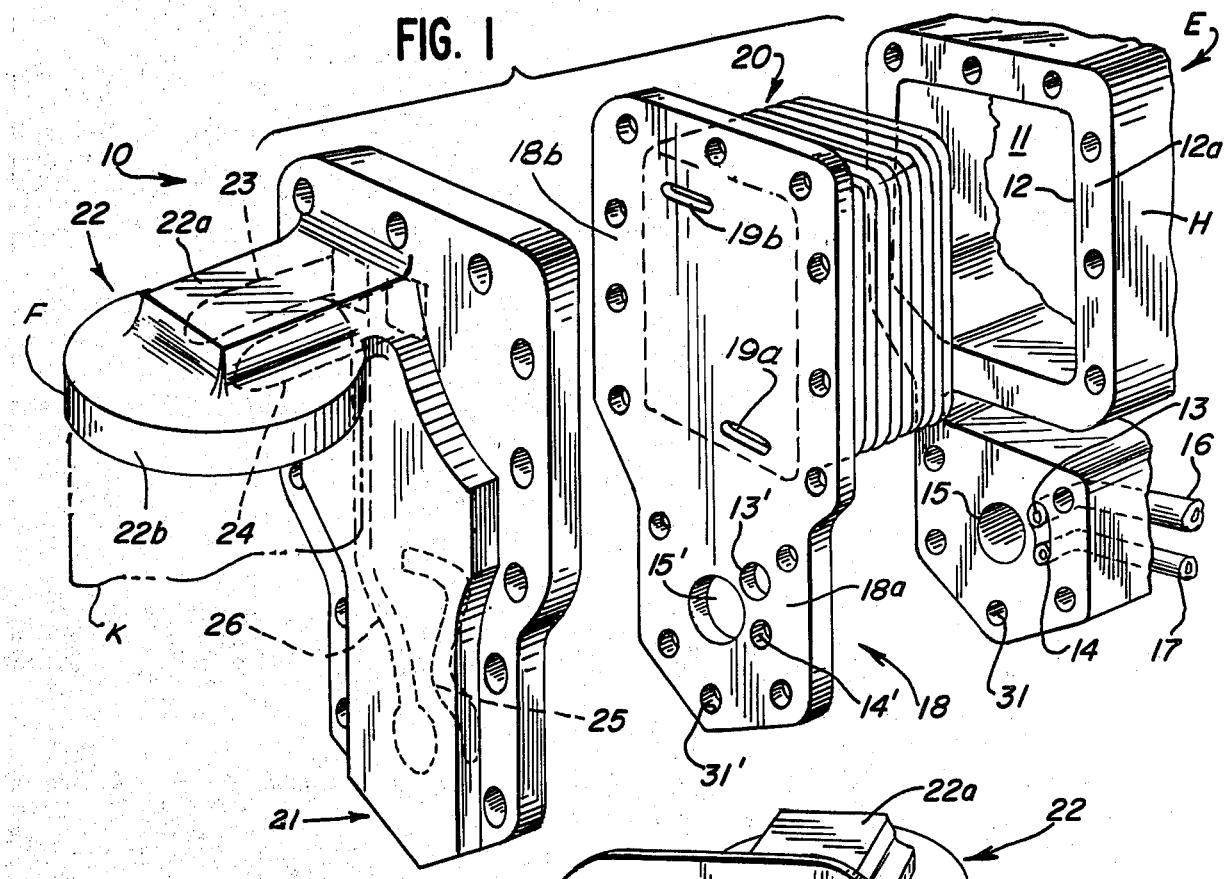
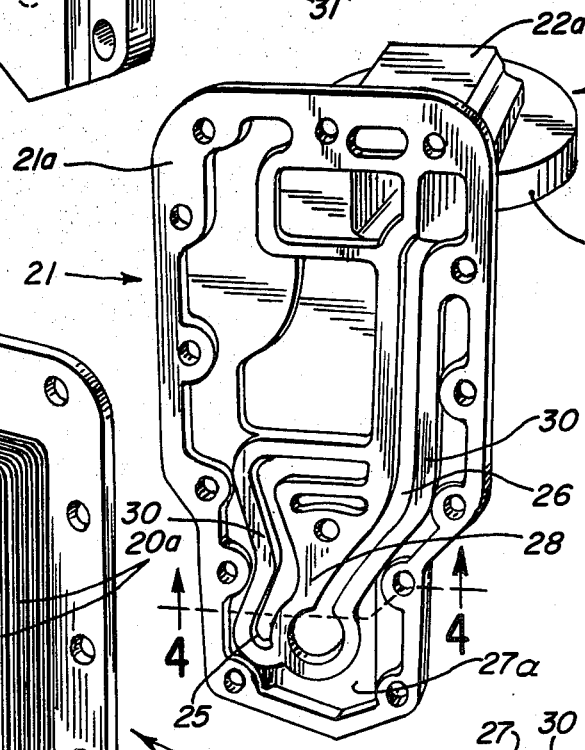
FIG. 2
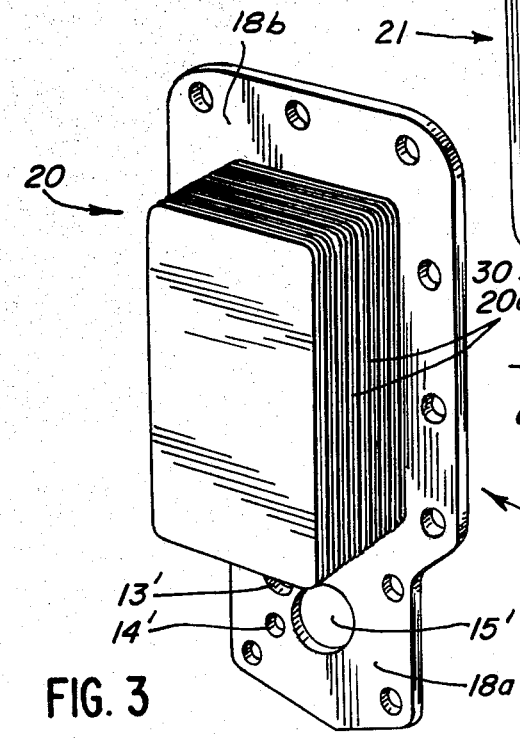
FIG. 3
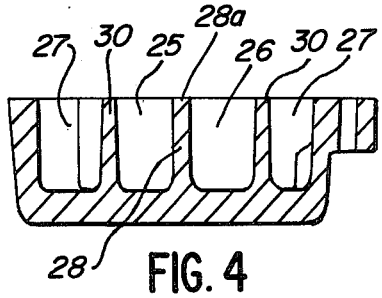
FIG. 4

LIQUID COOLING UNIT FOR AN INTERNAL COMBUSTION ENGINE

BACKGROUND OF THE INVENTION

The utilization of oil coolers on internal combustion (diesel) engines has been well known for many years; however, because of certain inherent design characteristics, they have been beset with one or more of the following shortcomings: (a) they are awkward and difficult to install because they embody an inordinate amount of fittings, hoses, piping, and the like; (b) they are of bulky, complex, and costly construction and thus, seriously limit where the units can be placed on the engine; and (c) the seals utilized in the units are subjected to high pressure oil during operation of the engine and thus, the likelihood of oil leakage is greatly enhanced.

SUMMARY OF THE INVENTION

Thus, it is an object of the invention to provide a liquid cooling unit which avoids all of the aforementioned shortcomings of the prior art.

It is a further object to provide a liquid cooling unit wherein the passages for the circulating liquid (oil) is concealed within the cover section of the unit.

It is a still further object to provide a liquid cooling unit which permits wide flexibility in the selection of sizes, shapes, and locations of various ports and passages formed therein so as to attain optimum cooling capacity.

Further and additional objects will appear from the description, accompanying drawings, and appended claims.

In accordance with one embodiment of the invention, an oil cooling unit for a diesel engine is provided having a heat exchange section which extends through an access opening into the cooling jacket for the engine. The heat exchange section is mounted on one side of a base section which is sealingly mounted in overlying relation with respect to the access opening. The base section is provided with a first set of ports which communicate with oil inlet and outlet ports formed in the engine, and a second set of ports which communicate with inlet and outlet ports for the heat exchange section. Sealingly mounted on the side of the base section opposite the heat exchange section is a cover section having a plurality of concealed passages. One of the passages interconnects one of the first set of ports with one of the second set of ports formed in the base sections and a second passage interconnects another of the first set of ports with another of the second set of ports.

DESCRIPTION

For a more complete understanding of the invention reference to the drawings wherein:

FIG. 1 is an exploded fragmentary perspective view of one form of the improved liquid cooling unit.

FIG. 2 is a perspective view of the cover section per se of the cooling unit shown in FIG. 1.

FIG. 3 is a perspective view of the heat exchange unit per se of the cooling unit shown in FIG. 1.

FIG. 4 is a sectional view taken along line 4—4 of FIG. 2.

Referring now to the drawings and more particularly to FIG. 1, one form of an improved liquid cooling unit 10 is shown which is adapted for use on an internal combustion engine E (e.g. diesel engine). The engine is provided with a housing H having a cooling jacket portion 11 which is adapted to surround the various cylinders, not shown. Water, or a suitable liquid coolant, is caused to circulate through the jacket portion during operation of the engine. The jacket portion is provided with a large access opening 12.

In addition to the jacket portion, the engine housing is provided, in the illustrated embodiment, with a plurality of exposed ports 13, 14, 15 which communicate, respectively, with an oil pressure line 16; an oil pressure relief line 17; and an oil return line, not shown. Under normal operating conditions the oil pressure within line 16 will not exceed 60 psig. The ports 13, 14, 15 and the access opening 12 are preferably in proximity to but spaced from one another.

The improved cooling unit 10 includes a plate-like base section 18 which is adapted to overlie and close off the access opening 12. The periphery of base section 18 is secured by suitable fasteners, not shown, to the portion 12*a* of the housing H circumjacent the access opening 12. A suitable gasket, not shown, is interposed the base section and the housing portion 12*a* so as to provide a seal between the base section and portion 12*a*. The base section has a lower portion 18*a* which is adapted to overlie the ports 13, 14, and 15. The lower portion 18*a* is provided with ports 13', 14', and 15' which are adapted to register with corresponding ports 13, 14, and 15 formed in the engine housing.

The same gasket, previously mentioned, may be of such a shape that it will have a portion thereof interposed the lower portion 18*a* of the base section and a corresponding portion of the housing adjacent the ports 13, 14, 15.

Affixed to one side of the upper portion 18*b* of the base section and projecting therefrom in one direction is a heat exchange section 20. The interior of the heat exchange section is provided with a tortuous passage, not shown. The opposite ends of the passage terminate at openings or ports 19*a*, 19*b* formed in the upper portion 18*b* of the base section 18. It will be noted in FIG. 1 that each opening 19*a*, 19*b* has a similar elongated configuration. The longitudinal axes of openings 19*a*, 19*b* are disposed in spaced substantially parallel relation. By reason of the elongated configuration of the openings 19*a*, 19*b* the spacing therebetween can be at a maximum, thereby enabling the flow distance through the passage of the heat exchange section 20 to be at a maximum.

The exterior of the heat exchange unit 20 includes a plurality of fin-like portions 20*a*, thus providing a substantial cooling surface. When the base section 18 is assembled on the engine housing H, the heat exchange section 20 extends through the access opening 12 into the housing interior 11 forming the cooling jacket. The exterior of the heat exchange section 20 is contacted by the liquid coolant which circulates through the jacket formed in the housing interior.

Removably mounted on the opposite, or outer, side of the base section 18 is a cover section 21 which is preferably a metal casting. The concealed side 21*a* of the cover section has a peripheral configuration which conforms substantially to the peripheral configuration of the outer side of base section 18. A suitable gasket, not shown, is interposed the base section and cover section and provides a suitable seal therebetween. Projecting from the exposed side of the cover section is a bracket 22 which includes an elongated arm segment 22*a* and a connecting segment 22*b* subtending the arm segment. The arm segment is provided with a pair of interior passages 23, 24, each of which terminates at one end at the concealed side 21*a* of the cover section and the opposite ends of the passages terminate at the connecting segment 22*b*.

The connecting segment 22*b* has a lid-like configuration with an internally threaded, depending flange F which is adapted to threadably and sealingly accommodate the upper end of a conventional oil filter K. When the liquid cooling unit 10 is in place on the engine housing, the bracket 22 is readily accessible so as to permit replacement of the oil filter when required.

The concealed side 21*a* of the cover section 21 is provided with a plurality of trough-like passages 25, 26, 27. Passage 25 interconnects port 19*a* formed in the upper portion of the base section 18 with the ports 13', 14' formed in the lower portion 18*a* of the base section. Passage 26, on the other hand, interconnects the port 19*b* with the return port 15' formed in the base section. Passages 25, 26 are separated from one another by projecting land portion 28; the height of the land portion 28 is such that the free edge 28*a* thereof is coplanar with concealed side 21*a*. Disposed outwardly from passages 25, 26 and separated therefrom by land portions 30 are segments of passage 27. Passage 27 serves as a relief channel for any liquid (oil) which might leak from passages 25, 26 while said liquid is flowing therethrough. Thus, by reason of passage 27, the liquid will not leak to the exterior of the cover section. The lower portion 27*a* of passage 27 communicates with a drain port 31' formed in the lower portion 18*a* of the base section. Drain port 31', in turn, is aligned with a suitable drain port 31 formed in the engine housing which permits the liquid accumulated in passage 27 to return to the crankcase of the engine, not shown. Besides providing a relief channel for the circulating liquid, the shape of the passage is such that less material is required to form the cover section thereby reducing the cost and weight thereof.

As aforementioned, the lower end of passage 25 communicates with both ports 13', 14'; thus, if the liquid pressure in line 16 should exceed a predetermined pressure (e.g. 60 psig), a pressure relief valve, not shown, provided in line 17, will open thereby causing the liquid flow to bypass the heat exchange unit and filter and go directly from line 16 to line 17 through ports 13', 14'.

By having the passages cast directly into the cover section, the need for separate piping and connectors to effect interconnection between various ports is avoided thereby significantly facilitating installation of the unit on an engine. Furthermore, utilizing the cover section as the transfer means for the circulating liquid (oil) permits greater latitude in selecting the size, shape, and location of the various ports so as to attain maximum cooling capacity for a given size unit.

The types of liquid and coolant utilized in conjunction with the unit may be varied from that heretofore described without departing from the scope of the invention.

I claim:

1. A removable cooling unit for mounting on the housing of an internal combustion engine, the housing having a first interior portion provided with an external inlet and an external outlet and through which a first liquid circulates and a second interior portion through which a second liquid circulates, the second interior portion being provided with a relatively large access opening, said unit comprising a removable base section for overlying the access opening and being sealingly secured to surface portions circumjacent the access opening, said base section being provided with a first set of ports adapted to register with the inlet and outlet of the first interior portion and a second set of ports spaced from said first ports; a heat exchange section carried on one side of said base section and protruding therefrom, said heat exchange section and said base section being of unitary construction and said heat exchange section being adapted to project through the access opening into the second interior portion whereby the exterior of said heat exchange section is positioned independently of the housing surfaces defining said access and is contacted only by the circulating second liquid, the interior of said heat exchange section being in communication with said second set of ports, the first liquid being adapted to circulate through the interior of said heat exchange section; and a cover section sealingly secured to a second side of said base section, said cover section having the surface thereof adjacent said base section concealed and provided with a plurality of independent passages, a first of said passages interconnecting a port of the first set with a port of the second set and a second of said passages interconnecting another port of the first set with another port of the second set.

2. The cooling unit of claim 1 wherein the first and second passages of said cover section are separated from the outer periphery of the concealed surface of said cover section by an intervening third passage for collecting any leakage of the first liquid flowing through the first and second passages of the cover section, said third passage communicating with a drain port formed in the base section.

3. The cooling unit of claim 1 wherein the passages of the cover section are formed by channels which coact with the second side of the base section.

4. The cooling unit of claim 1 wherein the cover section is provided with means for removably accommodating an exposed filter for the circulating first liquid, said filter being in communication with one of the passages formed in said cover section.

5. The cooling unit of claim 4 wherein the filter communicates with the cover section passage through which the first liquid flows subsequent to circulating through the heat exchange section.

6. The cooling unit of claim 1 wherein the ports of the second set formed in the base section are arranged in substantially spaced apart relation.

7. The cooling unit of claim 6 wherein the ports of the second set have elongated configurations with the elongated axes thereof in spaced substantially parallel relation.

* * * * *